US008156772B2

(12) United States Patent
Buhl et al.

(10) Patent No.: US 8,156,772 B2
(45) Date of Patent: Apr. 17, 2012

(54) PLATE LOCK

(75) Inventors: Joachim Buhl, Salzburg (DE); Eduard Buchmüller, Braunfels (DE)

(73) Assignee: Abus August Bremicker Sohne KG (DE)

( * ) Notice: Subject to any disclaimer, the term of this patent is extended or adjusted under 35 U.S.C. 154(b) by 0 days.

(21) Appl. No.: 12/821,819

(22) Filed: Jun. 23, 2010

(65) Prior Publication Data

US 2011/0154870 A1 Jun. 30, 2011

(30) Foreign Application Priority Data

Jun. 23, 2009 (DE) ..... 10 2009 030 036

(51) Int. Cl.
*E05B 67/06* (2006.01)

(52) U.S. Cl. ..... 70/49; 70/14; 70/18; 70/30; 70/53; 70/54; 70/57; 70/58

(58) Field of Classification Search ..... 70/14, 18, 70/19, 30, 49, 53, 54, 57, 58; 248/551, 552, 248/553; 59/78, 91, 92
See application file for complete search history.

(56) References Cited

U.S. PATENT DOCUMENTS

| | | | | | |
|---|---|---|---|---|---|
| 1,105,925 | A | * | 8/1914 | Reynolds | 59/78 |
| 3,747,376 | A | * | 7/1973 | White, Jr. | 70/18 |
| 3,757,514 | A | * | 9/1973 | Reist | 59/78 |
| 4,057,982 | A | * | 11/1977 | Drayton | 70/14 |
| 4,302,954 | A | | 12/1981 | Zisterer | |
| 4,694,667 | A | * | 9/1987 | Hodge | 70/49 |
| 4,760,718 | A | | 8/1988 | Muramatsu et al. | |
| 5,070,712 | A | * | 12/1991 | Fox | 70/18 |
| 5,475,993 | A | | 12/1995 | Kuo | |
| 5,913,906 | A | * | 6/1999 | Strocchi | 70/18 |
| 6,125,669 | A | | 10/2000 | McDaid et al. | |
| 6,427,499 | B1 | | 8/2002 | Derman | |
| 7,437,898 | B2 | * | 10/2008 | Su | 70/14 |
| 7,481,084 | B1 | * | 1/2009 | Wu | 70/18 |

(Continued)

FOREIGN PATENT DOCUMENTS

CA 1083843 8/1980

(Continued)

OTHER PUBLICATIONS

German Search Report dated Jun. 9, 2010 and Translation thereof.

(Continued)

*Primary Examiner* — Lloyd Gall
*Assistant Examiner* — David E Sosnowski
(74) *Attorney, Agent, or Firm* — Amster, Rothstein & Ebenstein LLP

(57) ABSTRACT

The invention relates to a plate lock having a lock body and a hinged bar hoop. A first end of the hinged bar hoop is permanently secured to the lock body and a second end of the hinged bar hoop can be latched to the lock body. The hinged bar hoop has a plurality of hinged bars which are pivotally connected to one another via a respective hinged connection. The hinged bars have a first eye and a second eye, wherein the respective hinged connection between two hinged bars has at least one hinged pin in order to connect the first eye of the one hinged bar to the second eye of the other hinged bar. The respective hinged bar has at least one bent metal wire or at least one folded sheet metal part which extends between the first eye and the second eye.

20 Claims, 5 Drawing Sheets

U.S. PATENT DOCUMENTS

| | | | | |
|---|---|---|---|---|
| 2005/0235710 | A1* | 10/2005 | Ling | 70/58 |
| 2007/0277569 | A1 | 12/2007 | Vitali | |
| 2009/0025437 | A1* | 1/2009 | Hentschel et al. | 70/186 |

FOREIGN PATENT DOCUMENTS

| | | | |
|---|---|---|---|
| DE | 102005040066 | A1 | 3/2007 |
| DE | 202007008047 | U1 | 10/2007 |
| DE | 202007009865 | U1 | 11/2007 |
| DE | 202008010482 | U1 | 1/2009 |
| EP | 0689987 | A1 | 1/1996 |
| EP | 1686049 | A1 | 8/2006 |
| FR | 2349012 | | 11/1977 |
| GB | 227994 | | 1/1925 |
| JP | 06026258 | A | 2/1994 |

OTHER PUBLICATIONS

European Search Report dated Nov. 5, 2010 and translation thereof.

* cited by examiner 67
23
59
65
71
15
75
63
61
69
25
73
75'
63'
61'

PLATE LOCK

The invention relates to a plate lock having a lock body and a hinged bar hoop. A first end of the hinged bar hoop is permanently connected to the lock body and a second end of the hinged bar hoop can be latched to the lock body. The hinged bar hoop has a plurality of hinged bars which are pivotally connected to one another via a respective hinged connection. The hinged bars have a first eye and a second, with the respective hinged connection between two hinged bars having at least one hinge pin in order to connect the first eye of the first hinged bar to the second eye of the other hinged bar.

A plate lock of this kind serves for example to secure a two wheeler to a bicycle stand, to a lamp post or the like. For this purpose hinged bars of the hinged bar hoop which are hinged to another in sequence are unfolded in order to surround the objects which are to be secured to one another. Then the hinged bar which forms the named second end of the hinged bar hoop is latched to the lock body in order to hereby form a closed loop. For the transport of the plate lock in the unused state the hinged bars can in contrast be folded together to form a compact arrangement. For this the individual hinged bars are coupled to one another via a respective hinged connection with a respective hinged pin engaging into an eye of the one hinged bar and/or an eye of the other hinged bar.

A plate lock of the above explained kind is for example known from the documents DE 10 2005 040 066 A1, U.S. Pat. No. 5,475,993, EP 0 689 987 A1 and JP 06026258A. In order to achieve a high security against being broken open the known plate locks are made particularly massive. As a result known plate locks have however an undesirably high weight.

It is an object of the invention to provide a plate lock with a lower weight.

This object is satisfied by a plate lock having the features of claim 1 and in particular in that the respective hinged bar has at least one bent metal wire or at least one folded sheet metal part which extends between the first eye and the second eye.

In the plate lock of the invention the hinged bars are formed essentially by metal wire or a sheet metal part or essentially by a metal wire or a sheet metal part and a sleeve, as will be explained in the following. With a metal wire this is generally a piece of metal manufactured by drawing. Metal wire is substantially rigid. In other words, the metal wire is of stable shape, i.e. the metal wire can (through high expenditure force) admittedly be bent into the form required to form the hinged bar, however it retains the bent shape (inelastic deformation). The metal wire can have a round force section (round wire) or can have a multi cornered cross-section, for example a rectangular or hexagonal cross-section (for example by cold deformation of a rounded wire). In the plate lock of the invention the cross-sectional diameter of the metal wire is smaller than the width of the respective hinged bar in the region of named eyes. In a sheet metal part this is generally a flat piece of metal which is manufactured by rolling and subsequent punching. The sheet metal part is also essentially rigid. In other words, the sheet metal part is of stable shape, i.e. the sheet metal part can, through a force expenditure) admittedly be folded into the form required to form the hinged bar however it retains the folded form (inelastic deformation).

A special feature of the plate lock lies in the fact that the respective hinged bar is not formed as a massive straight metal bar but rather has a bent or folded metal part in order to provide a light weight construction with adequate security against breaking open of the plate lock. In particular the respective hinged bar can have a metal wire which is bent in order to form a the first eye and second eye for the respective hinged connection between two hinged bars and a connection structure between the two eyes. Alternatively to this, the respective hinged bar can have a sheet metal part which is punched and folded in order to form the first eye and the second eye for the respective hinged connection between to two hinged bars and a connection structure between the two eyes. In this way, with a simple manufacture of the hinged bars an advantageously light construction of the hinged bar hoop and thus of the plate lock results. Nevertheless, an adequately high strength and stiffness of the hinged bars can be achieved, in particular with a suitable choice of the materials (for example steel) and of the material treatment (for example hardening). Thus a significant reduction in weight can be achieved with an adequate security against breaking open of the plate lock.

In the plate lock in accordance with the invention not all hinged bars must be formed in the explained manner with a metal wire or a sheet metal part. In particular this is not necessary for the hinged bars at the named first end and second end of the hinged bar hoop since the relevant hinged bars have in many cases a special design for the respective connection to the lock body. In order to achieve a significant reduction of weight, several of the hinged bars of the hinged bar hoop are however formed from a metal or with a sheet metal part, preferably at least four hinged bars.

Advantageous embodiments of the invention are named in the following and in the dependent claims.

In order to make it more difficult to attack the metal wire with the sheet metal part of the respective hinged bar in the case of an attempt to break it open and in order to facilitate the handling of the hinged bar hoop for the user it is preferred when the structure formed by the metal wire or the sheet metal part is completely or at least regionally surrounded by a respective sleeve. In particular the sleeve can endow the respective hinged bar with the shape of a flat bar although the force transmitting structure of the hinged bar is formed by a bent metal wire or by a folded and punched sheet metal part. In other words the total structure consisting of the sleeve and the metal wire or sheet metal part has a width in a normal plane to the longitudinal axis of the hinged bar between the eyes (measured perpendicular to the pivot axes of the hinged bar) which is larger than the height of the hinged bar (measured parallel to the pivot axes) and is in particular twice as large.

The said sleeve can have an injection molded plastic or an injection molded metal (in particular light weight metal, for example aluminum alloy or magnesium alloy). In this way, a closed shape of the respective hinged bar results with a low weight and simple manufacturing methods can be used (e.g. injection molding).

As an alternative to this the named sleeve can for example have two metal shells which are connected to one another.

With regard to the respective hinged connection between two hinged bars the already named hinged pin can have at least one rivet or at least one screw. A particularly simple and cost-favorable hinged connection can be made in that a rivet is inserted into the first eye of the hinged bar and into the second eye of the other hinged bar and is riveted in its position so that the rivet simultaneously forms a rivet axis as is shown in the initially named document DE 10 2005 040 066 A1. This rivet connection can be manufactured with or without washers between the two eyes. In a similar arrangement a screw having an external thread can be introduced into the two eyes from one direction and a screw having a corresponding internal thread can be introduced into the two eyes from the opposite direction which are screwed together in this position and thus form the named hinge pin. The respective hinged connection can however also be brought about using an intermediate piece with two separate preferably axially parallel hinged pins, in particular in the way this is shown in the initially named document JP 06026258A.

Having regard to the design of the respective hinged bar with a bent metal wire it is preferred when the metal wire extend within a plane so that a flat design of the hinged bar is achieved and the hinged bars can be folded together into a compact unit. In other words, the bending over of the metal wire takes place in this embodiment within a single plane which forms the plane of extent of the hinged bar and the different wire sections do not cross one another. Alternatively to this provision can however be made that the wire sections cross one another, for example at the center of the respective hinged bar between the two eyes. In accordance with a further alternative embodiment provision can also be made for the hinged bars to be cranked at least one end.

In order to achieve a high stability of the formed hinged bar it is furthermore preferred when the two ends of the respective metal wire are butt welded to one another and/or overlap within the plane of extent of a metal wire or of the respective hinged bar (i.e. extend adjacent to and parallel to another with or without welded connection).

In accordance with a particularly simple embodiment the respective hinged bar has only a single bent metal wire. Alternatively it is however also possible to provide a plurality of separate wires for a respective hinged bar in particular in an overlapping or encompassing arrangement.

In order to form the respective eye the metal wire is, in accordance with a further embodiment, bent into an open or a closed loop section at the relevant end of the hinged bar. A closed loop section can in particular be formed in that two sections of the metal wire or one wire section and one end of the metal wire are welded to one another. A particularly simple manufacture of the respective hinged bar results however, if the metal wire is bent to an open loop section. It results, that in this way an adequate stability of the respective hinged bar or of the formed hinged bar hoop can thus be achieved hereby, in particular when the relevant loop section is open at that side which is adjacent to the other respective eye of the hinged bar. The tensile forces which typically act in hinged connections during a break open attempt are namely directed in the opposite direction to this.

Having regard to the shaping of the metal wire in the region between the two eyes of the respective hinged bar a plurality of wire sections (in particular of a single wire piece) can extend alongside one another there. In particular two wire sections can extend parallel to the longitudinal axis of the hinged bar along the two edges in the region between the first eye and the second eye of the respective hinged bar. In this way particularly high edge stability of the relevant hinged bar is achieved.

The metal wire can in particular be bent into a substantially closed wire loop so that two wire sections extend alongside one another between the first eye and the second eye of the respective hinged bar which form a flat structure of the hinged bar. In this embodiment it is preferred when the wire loops have at a first end of the hinged bar at least one and preferably two mutually oppositely disposed constrictions in order to form the first eye of the hinged bar and when the wire loop at a second end of the hinged bar has at least one and preferably two mutually oppositely disposed constrictions in order to form the second eye of the hinged bar. In this way hinged connections of particularly stable shape result since the eyes are closed as a result of the constrictions along a particularly large peripheral region. Insofar as such constrictions are provided the two wire sections preferably extend spaced apart from one another between the eyes. It is however also possible that a substantially closed wire loop forms the two eyes, with the two wire sections extending directly alongside one another between the eyes. In this variant the above explained sleeve is not essentially required.

As an alternative to this it is however for example also possible for the metal wire to be bent essentially in a spiral manner such that three wire sections extend alongside one another between the first eye and the second eye of the hinged bar in order to form a flat structure of the hinged bar. With this embodiment also it is preferred when a loop section of the metal wire has at a first end of the hinged bar at least one and preferably two mutually oppositely disposed constrictions in order to form the first eye of the hinged bar and when a further loop section of the metal wire at a second end of the hinged bar has at least one and preferably two mutually oppositely disposed constrictions in order to form a second eye of the hinged bar.

In accordance with a further alternative embodiment only a single wire section can however also extend between the first eye and the second eye of the second respective hinged bar.

In contrast, having regard to the design of the respective hinged bar with a folded sheet metal part it is preferred when the sheet metal part is folded into at least two layers which lie directly above one another in order to form a multi-layer structure which is stable.

A particularly simple manufacture of the hinged bar results when openings are punched into the sheet metal part in order to form the first eye and the second eye of the respective hinged bar, in particular prior to the folding of the sheet metal part. In this way conical openings can also be formed without substantial additional effort in order to enable the reception of countersunk heads (for example of a rivet or of a screw) for the explained hinged connections.

In similar manner at least one cutout can be pierced into the sheet metal part in a region between the first eye and the second eye or in particular prior to the folding of the sheet metal part. A material cutout of this kind can be brought about with only a small additional effort during the manufacture of the hinged bars and leads to a substantial reduction in weight. This advantage is particularly significant when the named cutout leads continuously from the first eye to the second eye.

In accordance with a further advantageous embodiment the sheet metal part has at least one fold extending parallel to the longitudinal axis of the respective hinged bar which is arranged in the region of the first eye and of the second eye of the hinged bar is punched out between the two eyes. By allowing a fold to remain in the region of the two eyes a stable arrangement of the different layers of the folded sheet metal part relative to one another is achieved. Since, however, a substantial part of the fold region can be punched out prior to the folding, the sheet metal part can be more easily folded.

The invention also relates to a method for the manufacture of a hinged bar for a plate lock of the explained kind in which at least one metal wire is bent in order to form a first eye and a second eye and a connection structure between the two eyes. The manufacture method can include one or more of the following steps:

- drawing a metal piece in order to form a metal wire;
- bending a metal wire in order to form a first eye and a second eye and a connection structure between the two eyes, with the connecting structure having at least one wire section which extends between the first eye and the second eye;
- bending the metal wire to form a wire loop;
- forming at least one constriction at the wire loop in order to form the respective eye of the hinged bar;

connecting the two ends of the metal wire;

providing the bent metal wire with a sleeve;

connecting a plurality of hinged bars by means of a respective hinge pin which engages into the first eye of one hinged bar and into the second eye of the other hinged bar in order to form a hinged bar hoop; and/or fastening one end of the hinged bar hoop to a lock body.

The invention further relates to a method for the manufacture of a hinged bar for a plate lock of the explained kind in which at least one sheet metal part is punched and folded in order to form a first eye and a second eye and a connection structure between the two eyes. The manufacturing method can include one or more of the following steps:

rolling and subsequently punching a metal piece in order to form at least one sheet metal part;

folding the sheet metal part into at least two layers which are arranged directly above one another;

punching of openings into the sheet metal part in order to form a first eye and a second eye of the hinged bar;

punching a cutout into the sheet metal part which extends continuously from the first eye onto the second eye;

providing the folded sheet metal part with a sleeve;

connecting a plurality of hinged bars by means of a respective hinged pin which engages into the first eye of the one hinged bar and into the second eye of the other hinged bar in order to form a hinged bar hoop and/or securing one end of the hinged bar to a lock body.

The invention will be explained in the following simply by way of example with reference to the drawings.

Figures 2, 4A, 4B, 5:
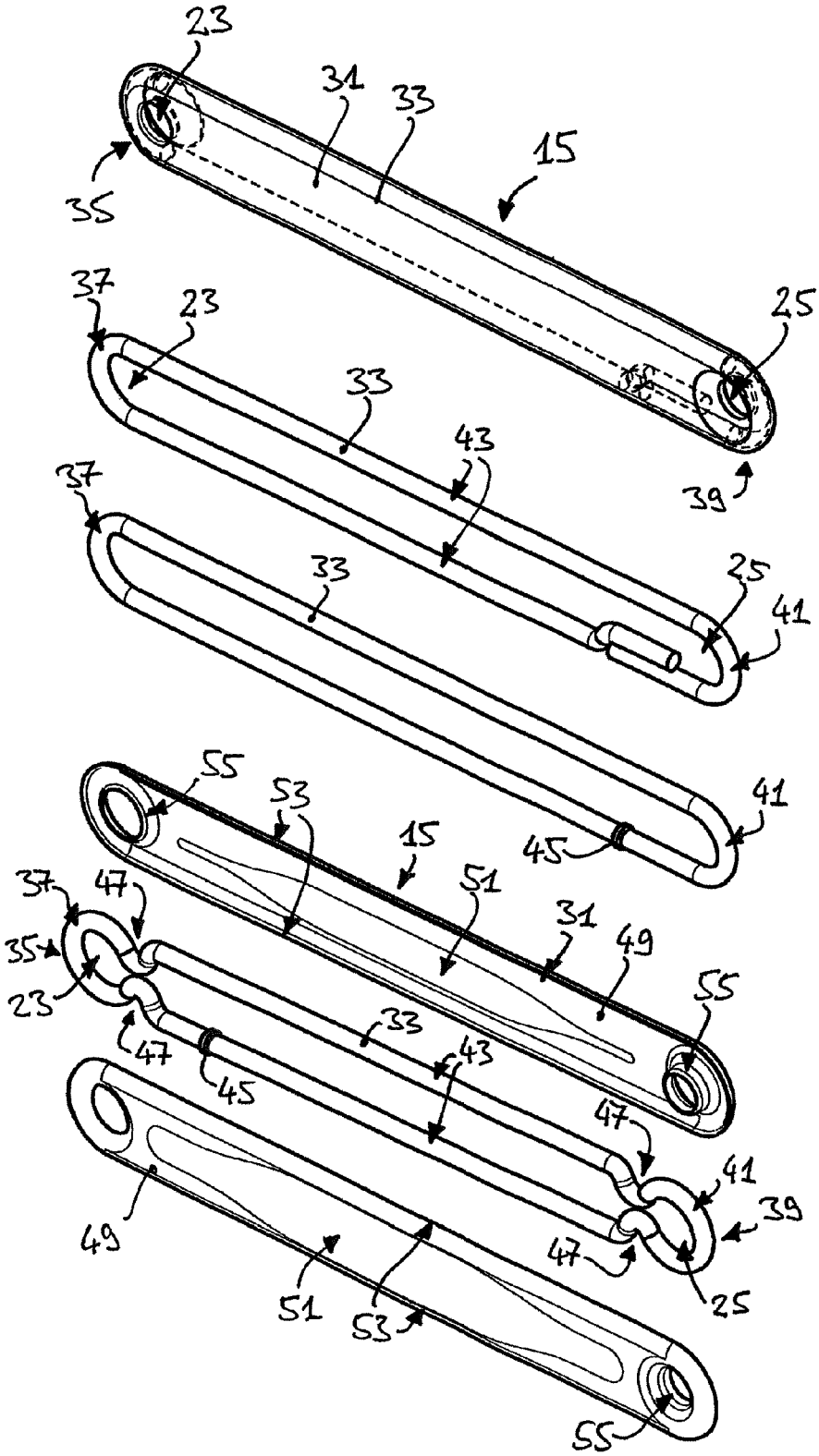
FIG. 2 shows a perspective view of a hinged bar in accordance with a first embodiment.
Figure 3C:
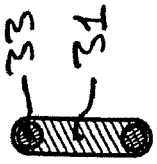
Figure 3A:
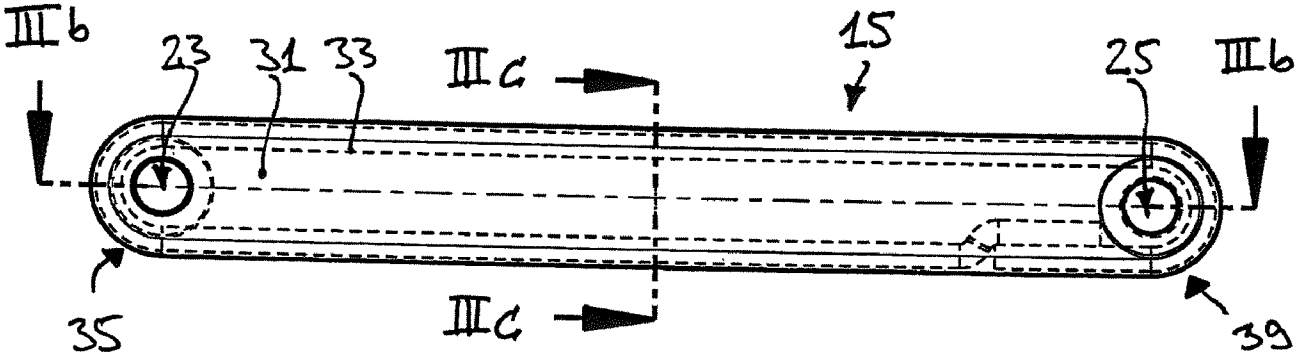
Figure 3B:
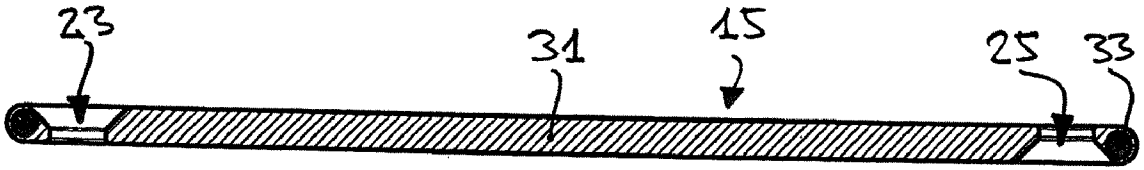

FIGS. 3*a*, 3*b* and 3*c* respectively show a plan view, a longitudinal section view and a cross-sectional view of the hinged bar of FIG. 2.

FIGS. 4*a* and 4*b* respectively show a perspective view of a bent metal wire of the hinged bar in accordance with FIG. 2 and a variant of this.

FIG. 5 shows an exploded view of a hinged bar in accordance with a second embodiment.

Figure 6C:
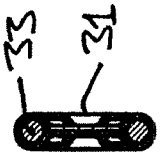
Figure 6A:
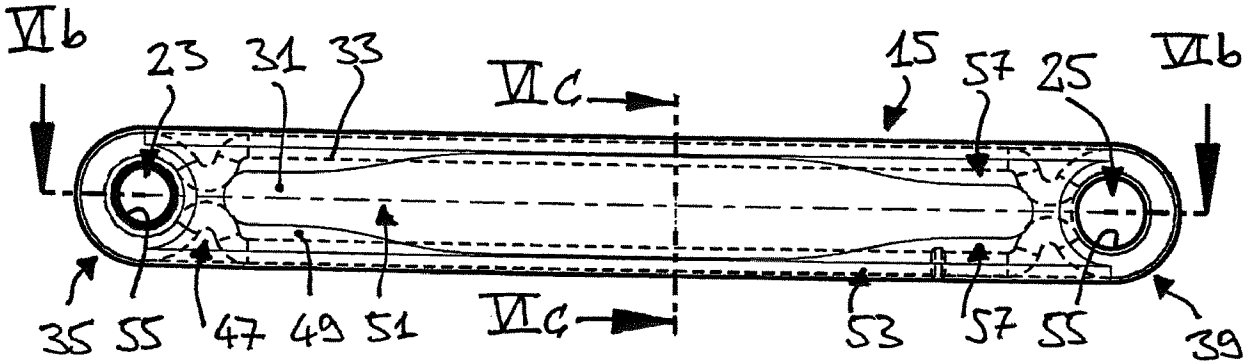
Figure 6B:
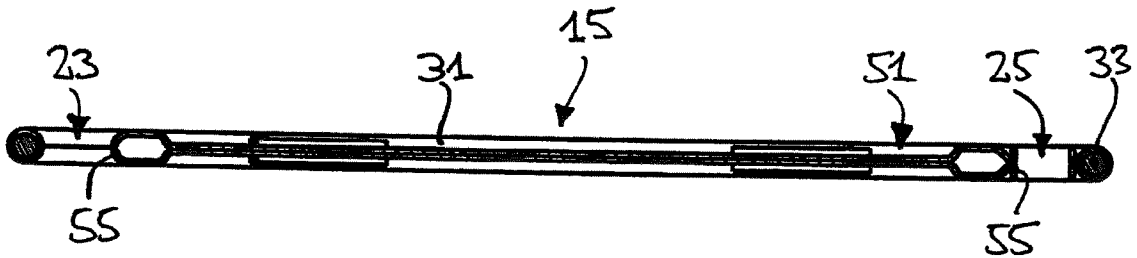

FIGS. 6*a*, 6*b* and 6*c* respectively show a plan view, a longitudinally sectional view and a cross-sectional view of the hinged bar of FIG. 5.

FIGS. 7*a* to 7*d* show schematic views of different shapes of a metal wire of a hinged bar.

Figures 8A, 8B, 8C:
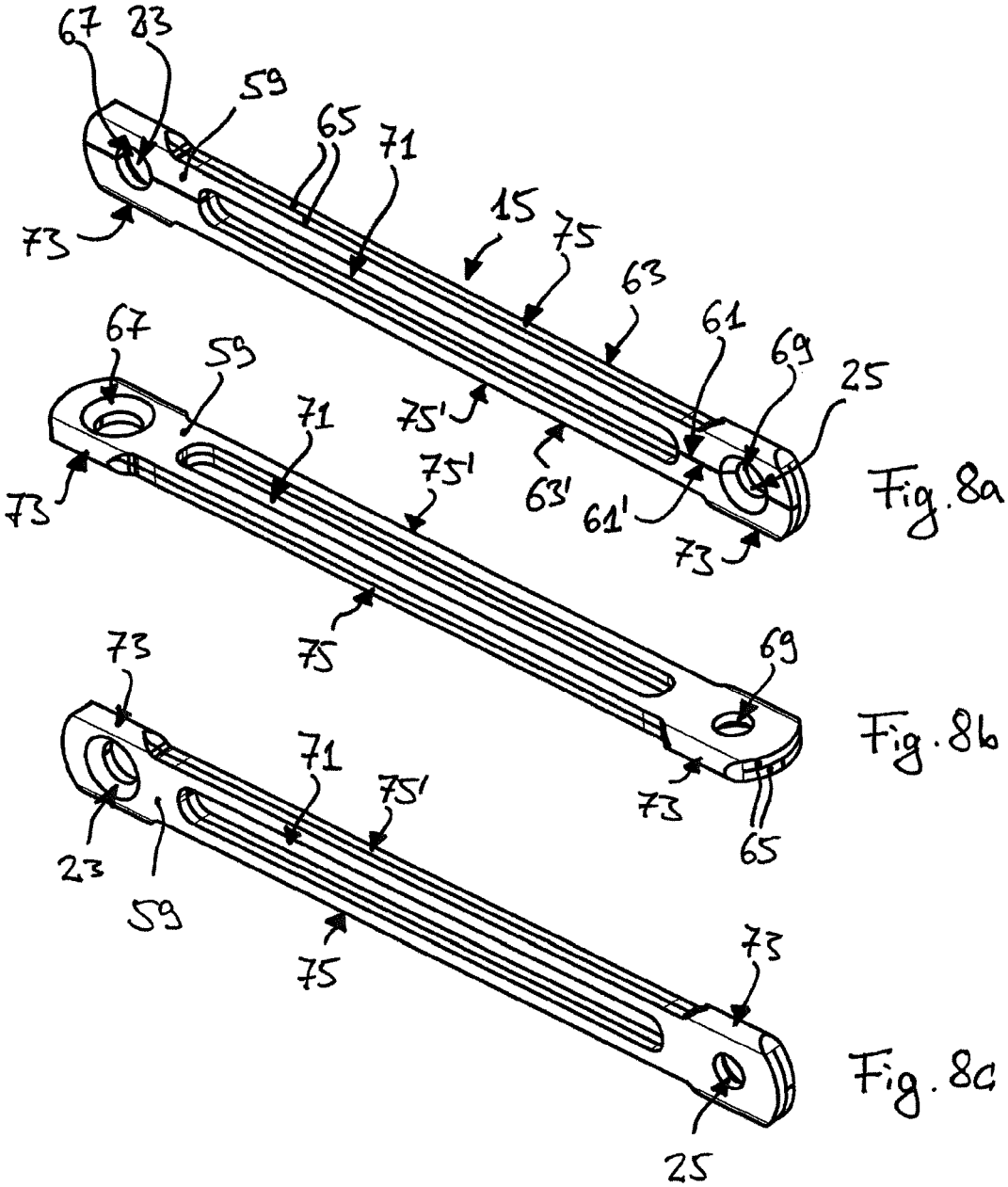

FIGS. 8*a*, 8*b* and 8*c* show different perspective views of a hinged bar in accordance with a third embodiment.

Figure 1:
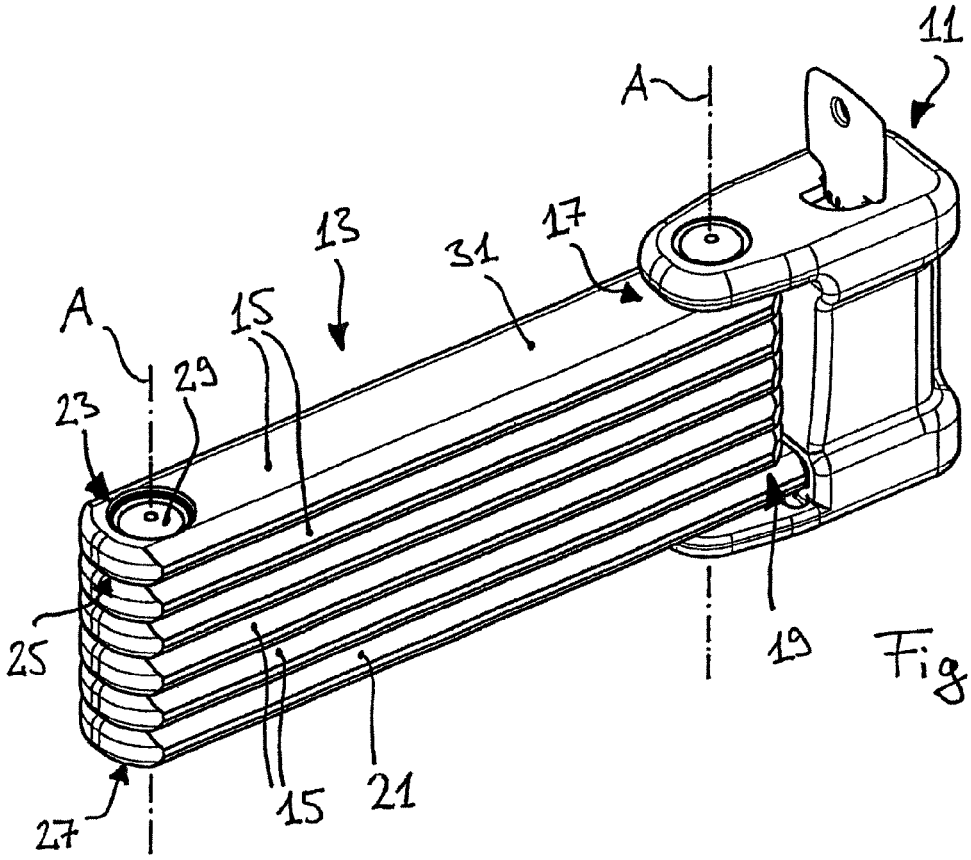
FIG. 1 shows a perspective view of a plate lock.

The plate lock shown in FIG. 1 has a lock body 11 and a hinged bar hoop 13 secured thereto with a plurality of flat, substantially rigid hinged bars 15. The hinged bar hoop 13 can, as is shown, be folded together to form a compact packet of axially parallel hinged bars 15 in the manner of a folding rule and can also be locked in the state to the lock body 11. For this purpose the pivot axes A of the hinged bars 15 extend parallel to one another. In the unlocked state of the plate lock (not shown) the hinged bar hoop 13 can however also be unfolded in order to form a loop in manner known per se and to hereby lock up a two wheeler or to secure to another object (for example a bicycle stand).

A first end of the hinged bar hoop 13 is pivotally connected to the lock body 11. The hinged bar provided at a second end of the hinged bar hoop 13 forms a closing bar 21. The hinged bars 15 and the closing bar 21 are pivotally connected to one another in series via a respective hinged connection with the hinged bars 15 each having a first eye 23 and a second eye 25 (covered over in FIG. 1). The closing bar 21 has only a single eye 27. The said respective hinged connection between the hinged bars 15 has a hinged pin 29 in the form of a rivet which engages into the first eye 23 of the first respective hinged bar 15 and to the second eye 25 of the other respective hinged bar 15.

The lock body 11 has substantially an elongate shape and extends parallel to the pivot axes A of the hinged bars 15. The second end 19 of the hinged bar hoop 13, i.e. the free end of the closing bar 21 can be introduced in the side in the lock body 11 and can be latched there by means of a latching device which is not shown in more detail. The latching device can in known manner have a lock cylinder and a latch element.

A special feature of the plate lock as is shown consists in a layout of the hinged bars 15. FIG. 2 and FIGS. 3*a*, 3*b* and 3*c* show a first embodiment of a hinged bar 15. The hinged bar 15 has a metal wire 33 (shown in broken lines in FIGS. 2 and 3*a*) within a sleeve 31 which is bent to form a substantially closed wire loop and hereby forms the first eye 23 and the second eye 25 of the hinged bar 15. FIG. 4*a* shows the metal wire 33 without the sleeve 31.

The sleeve 31 consists in this embodiment of an injection molded plastic which is injected around the metal wire 33. A sleeve 31 and a metal wire 33 jointly form a flat bar shape, with the metal wire 33 only being bent within one plane.

Having regard to the shaping of the metal wire 33 anew, the metal wire 33 is bent at a first end 35 of the hinged bar to an open loop section 37 of 180° in order to form the first eye 23. At a second end 39 of the hinged bar 15 the metal wire 33 is bent into an open loop section 41 of 180°, in order to form the second eye, with the open sides of the two loop sections 37, 41 respectively facing in the direction of the other respective loop section 41 and 37. Two wire sections 43 thus extend between two wires 23, 25 parallel to one another and spaced apart from one another or along the longitudinal axis of the hinged bar 15. The two wire sections 43 form a connection structure which connects the two eyes 23, 25 to one another.

The wire loop formed from metal wire 33 is not completely closed so that the two wire ends overlap parallel to the longitudinal axis of the hinged bar 15 but are not however fixedly connected (see FIG. 4*a*). A weld connection can however additionally be provided at the region of overlap. Furthermore, alternative to such overlapping of the wire ends, provision can be made for the two ends of the metal wire 33 to be butt welded to one another as is shown in the variant in accordance with FIG. 4*b* (weld seam 45). As an alternative to the variant of FIG. 4*b* the two ends of the wire 33 can also loosely abut one another, i.e. without a weld seam 45 (not shown). In a particular stable embodiment a respective reinforcement sleeve can be provided at the two ends 35, 39 of the hinged bar 15 or at the two loop sections 37, 41 of the wire 33 which have a one sided axial opening by which the reinforcement sleeve can be mounted along the longitudinal axis of the hinged bar 15 onto the relevant hinged bar end 35, 39 and which further has a through going opening in the transverse direction to form the respective eyes 23, 25 (likewise not shown). In this case the respective hinged bar 15 preferably consists exclusively of the wire 33, a plastic injection molding as sleeve 31 and the said reinforcing sleeves.

Metal wire 33 is for example formed of a hardened steel and can thus have a high resistance to clipping and sawing.

The design of the hinged bar 15 in accordance to FIGS. 2 to 4 enables a particularly light construction of the hinged bar hoop 13 of a plate lock (FIG. 1). At the same time a simple and correspondingly cost-favorable manufacture is possible. The establishing of a respective hinged connection between two adjacent hinged bars can take place in customary manner, in particular by riveting or by screwing to the eyes 23, 25.

Nevertheless the hinged bars 15 have the necessary strength and stiffness and the hinged bar hoop 13 formed from the hinged bars 15 is characterized by an adequately high security against being broken open.

A second embodiment of the hinged bar 15 with wire construction is shown in FIGS. 5 and 6 with similar elements to those in FIGS. 2 to 4 being characterized by the same reference numerals.

In distinction to the variant of FIG. 4*b* the metal wire 33 here has two mutually oppositely disposed constrictions 47 both at the first end 35 and also at the second end 29 of the hinged bar 15 in order to form the first eye 23 and the second eye 25. The respective loop section 37 of the metal wire 33 extends almost over the full periphery of the respective eye 23, 25 so that particularly stable eyes 23, 25 are formed. At the mutually oppositely disclosed constrictions 47 a weld connection can optionally be provided in order to form an eye 23, 25 which is peripherally fully closed.

A further distinction to the first embodiment of FIGS. 2 to 4 consists in the fact that in the second embodiment of FIGS. 5 and 6 the sleeve 31 has two shells 49 of metal which surround the metal wire 33. The shells 49 also form in this embodiment a flat bar shape together with the metal wire 33. The shells 49 have a central depression 51 in order to firmly embed the metal wire 33 with the arched rim 53. In the region of the eyes 23, 25 the shells 49 have beaded in regions 55 which engage into the respective loop section 37, 41 of the metal wire 33 and thus further stabilize the eyes 23, 25. Between the wire sections 43 and the shells 49 of the sleeve 31 some hollow cavities 57 are formed which contribute to a reduction in weight (FIG. 6*a*).

The two shells 49 can for example be press-connected to one another or can be welded (preferably extending weld seam or a plurality of spot welds).

Instead of the shells 49 another form of multi-part housing of metal or plastic can also be provided as a sleeve 31.

Figure 7A:
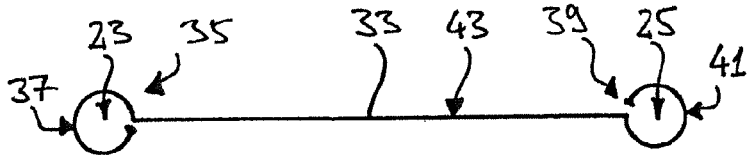
Figure 7B:
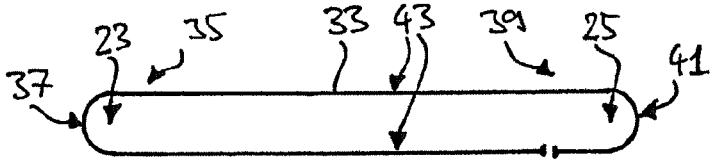
Figure 7C:
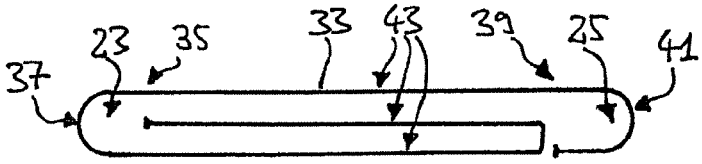

FIGS. 7*a* to 7*c* schematically show possible forms of the metal wires 33.

In accordance with FIG. 7*a* an almost completely closed loop section 37 and an almost completely closed loop section 41 are respectively provided at the two ends 35, 39 of the relevant hinged bar in order to form a first eye 23 and a second eye 25 respectively. Only a single wire section extends however between the two eyes 23, 25. The two loop sections 37, 41 can also be completely closed by welding. With this shaping a sleeve 31 is not necessarily essential.

In accordance with FIG. 7*b* the metal wire 33 is bent to form a substantially closed wire loop explained in connection with FIGS. 2 to 4 and also with FIGS. 5 and 6.

FIG. 7*c* shows a variant in which the metal wire 33 is bent in a substantially spiral manner so that three wire sections 43 extend alongside one another between the first eye 22 and the second eye 25. In this variant also constrictions 47 can be provided at the first end 35 and the second end 39 of the relevant hinged bar as explained in connection with the embodiment of FIGS. 5 and 6. Furthermore the wire end can also be welded at the second end 39 of the hinged bar to the neighboring wire section 43.

Figure 7D:
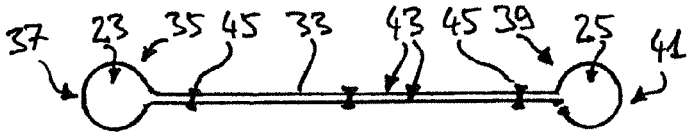

FIG. 7*d* shows a further variant in which the metal wire 33 is bent into a substantially closed wire loop in similar manner to FIG. 7*b*. Between the eyes 23, 25 the two wire sections 43 however extend directly adjacent to one another, i.e. the two wire sections 43 are arranged bordering one another. The two wire sections 43 can optionally be firmly connected together between the eyes 23, 25, in particular by at least one weld seam 45 (for example by spot welding or line welding). The loop section 41 can also be completely closed. In this further variant a sleeve 31 is also not necessarily essential.

FIGS. 8*a* to 8*c* show a third embodiment of a hinged bar 15 for a plate lock in accordance with FIG. 1. In this embodiment the hinged bar 15 is formed by a punched and folded sheet metal part 59. The sheet metal part 59 is folded in such a way that the longitudinal edges 61, 61' of the sheet metal part 59 extending parallel to the longitudinal axis of the hinged bar 15 are arranged adjacent to one another at the center between the two longitudinal edges 63, 63' of the hinged bar 15 (FIG. 8*a*). The hinged bar 15 thus consists only of two layers 65 of the sheet metal part 59 which lie flatly against one another and are arranged directly above one another. First openings 67 are punched into the sheet metal part 59 which in the folded state of the sheet metal part 59 are arranged in alignment with one another in order to form the first eye 33. Second openings 69 are also punched into the sheet metal part 59 in corresponding manner in order to form the second eye 25.

Between the first eye 23 and the second eye 25 a plurality of further openings is punched into the sheet metal part which, in the folded state of the sheet metal part 59 jointly form a central cutout 71. The cutout 71 extends along the longitudinal axis of the hinged bar 15 continuously between the first eye 23 and the second eye 25. As an alternative to this the cutout 71 can however also be interrupted by a plurality of transverse webs.

The folded sheet metal part 59 has at each of the two longitudinal edges 63, 63' of the hinged bar 15 a respective fold 73 in the region of the first eye 23 and of the second eye 25. The respective region between two folds 73 of a longitudinal axis 63 and 63' respectively, is punched out, i.e. the sheet metal part has further lateral cutouts 75 and 75' respectively in these regions.

The named openings 67, 69 and cutouts 71, 75, 75' are punched into the sheet metal part 59 prior to folding, and this can take place in a single working step together with the punching out of sheet metal part 59 from a larger web of material.

Thus a cost-favorable manufacture of the hinge bar 15 in accordance with FIGS. 8*a* to 8*c* is possible by punching and folding of a single sheet metal part 59. The sheet metal part 59 can be formed of hardened steel. In this way a high security against breaking open of the plate lock is ensured. Through the provision of a sensor cutout 71 and also of the lateral cutouts 75, 75' a significant reduction of weight is achieved.

The sheet metal part 59 of the hinged bar 15 of FIGS. 8*a* to 8*c* can also be provided with a sleeve 31 as is explained for the first and second embodiment in accordance with FIGS. 2 to 6.

REFERENCE NUMERAL LIST

11 lock body
13 hinged bar hoop
15 hinged bar
17 first end of the hinged bar hoop
19 second end of the hinged bar hoop
21 closing bar
23 first eye
25 second eye
27 eye of the closing bar
29 hinged pin
31 sleeve
33 metal wire
35 first end of the hinged bar
37 loop section
39 second end of the hinged bar
41 loop section

43 wire section
45 weld seam
47 constriction
49 shell
51 depression
53 edge
55 beaded in region
57 hollow cavity
59 sheet metal part
61, 61' longitudinal edge of the sheet metal part
63, 63' longitudinal edge of the hinged bar
65 layer
67 first opening
69 second opening
71 central cutout
73 fold
75, 75' lateral cutout
A pivot axis

The invention claimed is:

1. Plate lock having a lock body and a hinged bar hoop in which a first end of the hinged bar hoop is permanently secured to the lock body and a second end of the hinged bar hoop can be latched to the lock body, wherein the hinged bar hoop has a plurality of hinged bars which are pivotally connected to one another via a respective hinged connection, wherein the hinged bars have a first eye and a second eye and wherein the respective hinged connection between two hinged bars has at least one hinged pin in order to connect the first eye of the one hinged bar to the second eye of the other hinged bar, and wherein the respective hinged bar has at least one bent metal wire which extends between the first eye and the second eye.

2. Plate lock in accordance with claim 1, wherein the at least one bent metal wire of the respective hinged bar is at least regionally surrounded by a sleeve.

3. Plate lock in accordance with claim 2, wherein the sleeve together with the at least one bent metal wire forms a flat bar shape.

4. Plate lock in accordance with claim 2, wherein the sleeve comprises plastic.

5. Plate lock in accordance with claim 2, wherein the sleeve has two shells which are connected to one another.

6. Plate lock in accordance with claim 2, wherein a hollow space is formed between the at least one bent metal wire on the one hand and the sleeve on the other hand, at least regionally.

7. Plate lock in accordance with claim 1, wherein the respective hinged bar is substantially rigid.

8. Plate lock in accordance with claim 1, wherein the at least one hinged pin of the respective hinged connection has at least one rivet or at least one screw.

9. Plate lock in accordance with claim 1, wherein the at least one hinged pin of the respective hinged connection engages into the first eye of the one hinged bar and into the second eye of the other hinged bar.

10. Plate lock in accordance with claim 9, wherein the pivot axes of the hinged bars extend parallel to one another such that the hinged bar hoop can be folded together to form a packet in which the hinged bars extend parallel to one another.

11. Plate lock in accordance with claim 1, wherein the at least one bent metal wire forms the first eye and the second eye of the respective hinged bar.

12. Plate lock in accordance with claim 1, wherein the at least one bent metal wire of the respective hinged bar extends within a plane.

13. Plate lock in accordance with claim 1, wherein the at least one bent metal wire has two ends, with the two ends of the at least one bent metal wire being at least one of butt welded or overlapping.

14. Plate lock in accordance with claim 1, wherein the at least one bent metal wire is a single metal wire.

15. Plate lock in accordance with claim 1, wherein the at least one bent metal wire has a round cross-section.

16. Plate lock in accordance with claim 1, wherein the at least one bent metal wire is bent at a first end of the respective hinged bar to an open or closed loop section in order to form the first eye and wherein the at least one bent metal wire is bent at a second end of the respective hinged bar into an open or closed loop section in order to form the second eye.

17. Plate lock in accordance with claim 1, wherein the at least one bent metal wire comprises a plurality of wire sections which extend alongside one another between the first eye and the second eye of the respective hinged bar.

18. Plate lock in accordance with claim 1, wherein the at least one bent metal wire is bent into an at least substantially closed wire loop.

19. Plate lock in accordance with claim 18, wherein the wire loop has at a first end of the respective hinged bar at least one and preferably two constrictions in order to form the first eye of the hinged bar and wherein the wire loop has at a second end of the respective hinged bar at least one and preferably two constrictions in order to form the second eye of the hinged bar.

20. Plate lock in accordance with claim 1, wherein the at least one bent metal wire of the respective hinged bar is at least regionally. surrounded by a sleeve, the sleeve together with the at least one bent metal wire forming a flat bar shape, wherein the at least one hinged pin of the respective hinged connection engages into the first eye of the one hinged bar and into the second eye of the other hinged bar, and wherein the pivot axes of the hinged bars extend parallel to one another such that the hinged bar hoop can be folded together to form a packet in which the hinged bars extend parallel to one another.

* * * * *